United States Patent [19]

Triadu et al.

[11] Patent Number: 4,776,480

[45] Date of Patent: Oct. 11, 1988

[54] WASTE-PAPER BASKET AND STRAP ADAPTED TO THE ATTACHMENT OF THE BASKET

[75] Inventors: Alain Triadu, Levallois-Perret; Michel Moret, Ermont, both of France

[73] Assignee: Allibert, S.A., Grenoble Cedex, France

[21] Appl. No.: 908,857

[22] Filed: Sep. 18, 1986

[30] Foreign Application Priority Data

Sep. 18, 1985 [FR] France ..... 85 13811

[51] Int. Cl.[4] ..... B65D 43/00

[52] U.S. Cl. ..... 220/18; 220/1 T

[58] Field of Search ..... 220/1 T, 18, 85 H

[56] References Cited

U.S. PATENT DOCUMENTS

| | | | |
|---|---|---|---|
| 681,493 | 8/1901 | Cameron et al. | 220/18 |
| 1,485,496 | 3/1924 | Elliott | 220/18 X |
| 1,594,535 | 8/1926 | Lindbeck | 220/18 |
| 1,860,224 | 5/1932 | Bode | 220/18 |
| 2,568,041 | 9/1951 | Van Outrive | 220/18 X |
| 3,235,119 | 2/1966 | Smith | 220/1 T X |
| 4,217,073 | 8/1980 | Propst | 220/1 T X |
| 4,445,619 | 5/1984 | Kubic et al. | 220/1 T X |

FOREIGN PATENT DOCUMENTS

| | | |
|---|---|---|
| 60794 | 9/1982 | European Pat. Off. . |
| 2460123 | 1/1981 | France . |
| 7330860 | 11/1973 | Fed. Rep. of Germany . |

*Primary Examiner*—Steven M. Pollard

*Attorney, Agent, or Firm*—Pollock, VandeSande & Priddy

[57] ABSTRACT

The invention applies to a waste-paper basket having a detachable tub for receiving litter held against a support column by a hook-and-bolt system. According to the invention, the support column (2) has towards its upper part (2) an element forming a tub-cover (2) completely solid with an elongated central beam essentially vertical in its position of use. The invention applies in particular to a basket intended to be used at a fixed site in the street to receive litter tossed away by passersby.

10 Claims, 6 Drawing Sheets

FIG. 4
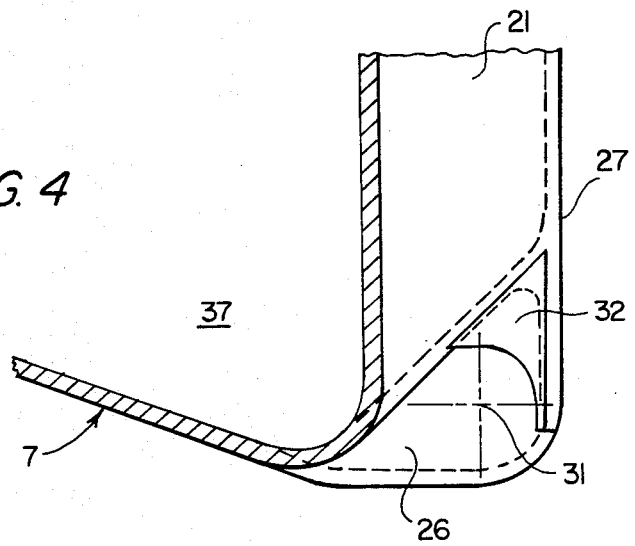
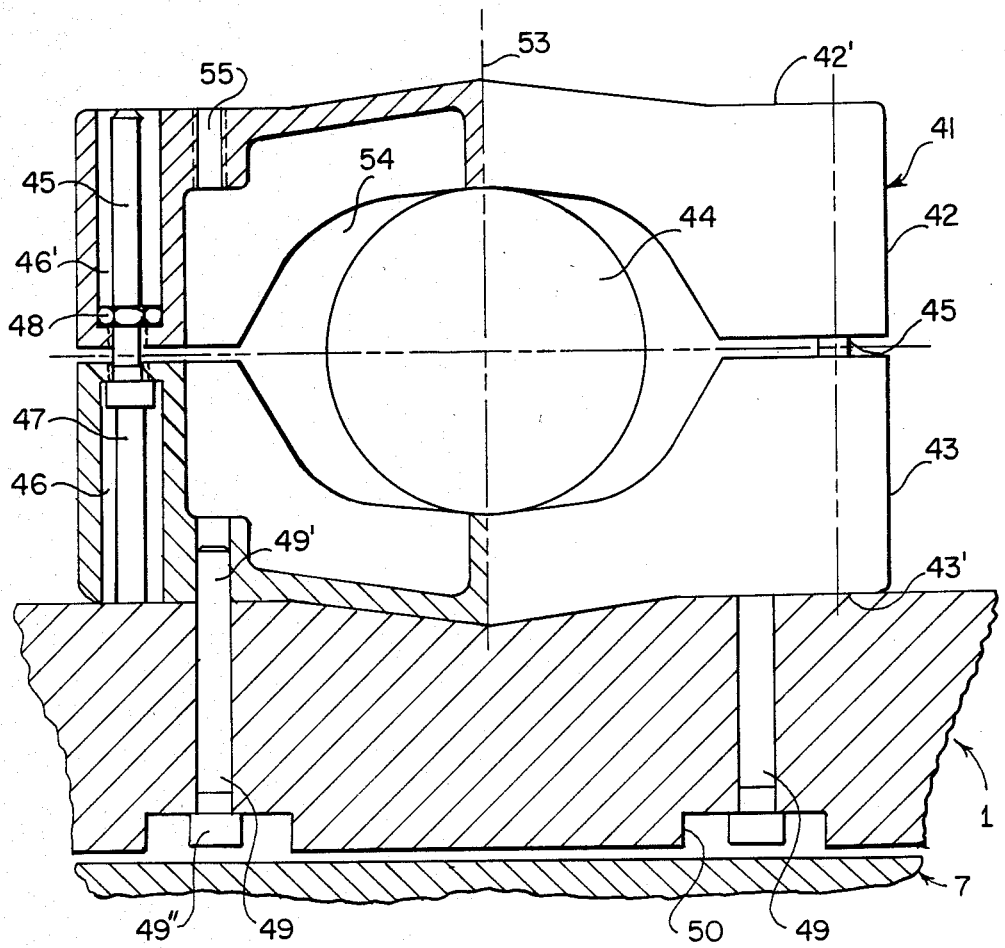
FIG. 11

FRONT
REAR
500
501
17
19
20
7
29
39

500
501
20
7

2
FRONT
4
X
630
600
X
610
BOTTOM 620
600
610

FIG. 17
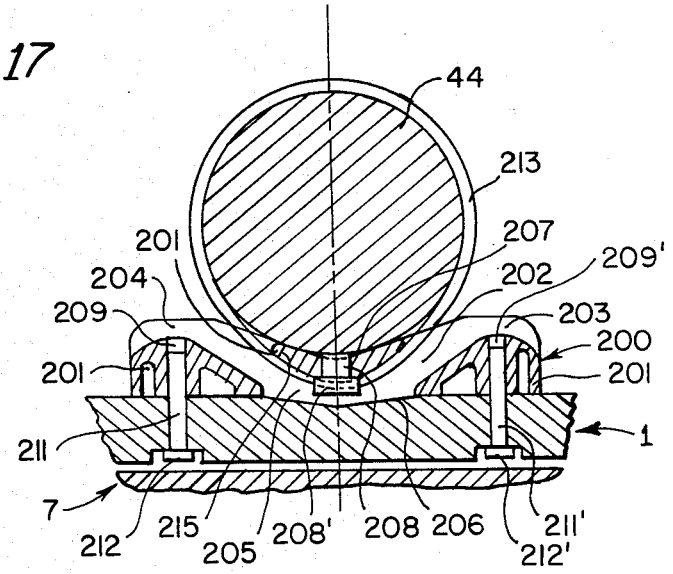
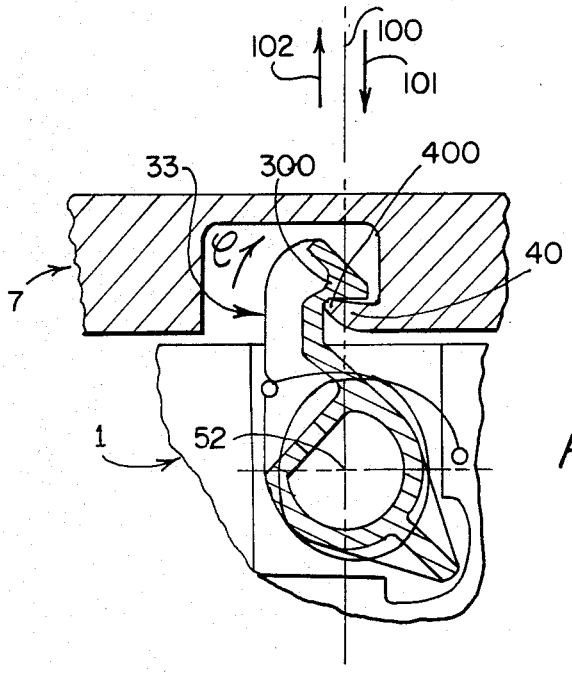
FIG. 16

WASTE-PAPER BASKET AND STRAP ADAPTED TO THE ATTACHMENT OF THE BASKET

FIELD OF THE INVENTION

The invention concerns a waste-paper basket of the type having a detachable tub resting against a support column and a strap for attaching said basket in position. The basket is more particularly intended to be used at a fixed site in the street to receive the litter thrown away by passersby.

BACKGROUND OF THE INVENTION

Baskets of this type generally have a cover for the tub mounted to rotate around an axis by means of accessory parts connecting the cover to the support between a closed position, which prevents the tub from being withdrawn from the support on which it is held, and an open position, which allows the tub to be removed, in particular to be emptied. In addition, a bolt-lock system makes it possible to turn the cover, thus freeing up the tub. However, these systems are complex and require significant number of connecting parts. Furthermore, movable covers, if they are made of plastic, often undergo deformations.

SUMMARY OF THE INVENTION

The invention is in particular intended to remedy these drawbacks.

To this end, according to the invention the support column includes, towards its upper part, an element forming a tub-cover completely solid with an elongated central beam that is essentially vertical in its position of use. More specifically, the basket includes a detachable litter-receiving tub supported against a support column by a system of hooking and bolting and including a means of pivoting around an essentially horizontal axis located towards its base.

This arrangement makes it possible to obtain a fixed element that ensures both at least partial covering of the tub, while at the same time allowing litter to be tossed into it, and its being held in position. In this way, in ordinary use only the tub is movable and detachable from its support column.

Advantageously, the tub includes its upper end, on at least one of its outer surfaces, at least one projecting part forming at least one incline that cooperates with at least one lug formed on the support column having at least one complementary cooperating shaft. In this way, the tub is held in a stable position even when the tub is unbolted. Indeed, as the tub is articulated around an axis located towards its base, it would fall towards the operator as soon as it is unbolted were it not held by these complementary cooperating inclines.

The invention likewise applies to a strap for fixing in position a waste-paper basket according to the invention, the trash can then being solid with a post set in the ground.

BRIEF DESCRIPTION OF THE FIGURES

The invention, its characteristics and advantages will appear more clearly with the aid of the following description, given in reference to the attached drawings, in which.

Figure 2:
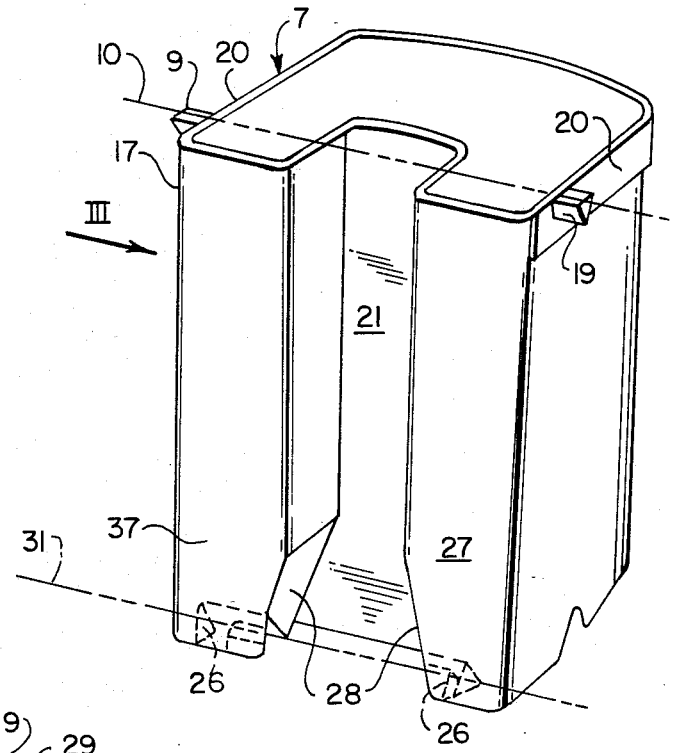
FIG. 2 shows a diagrammatic view in perspective of the tub.
Figure 3:
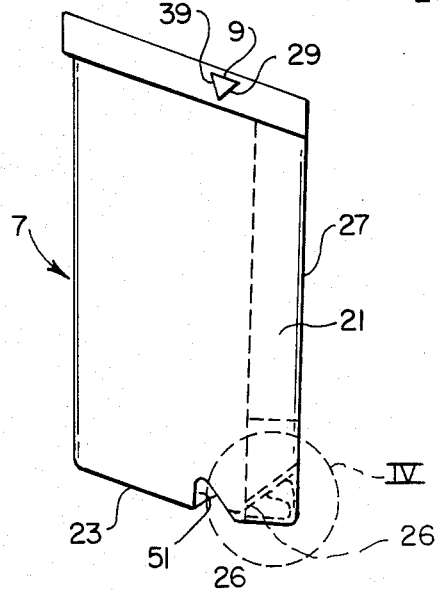
Figure 7:
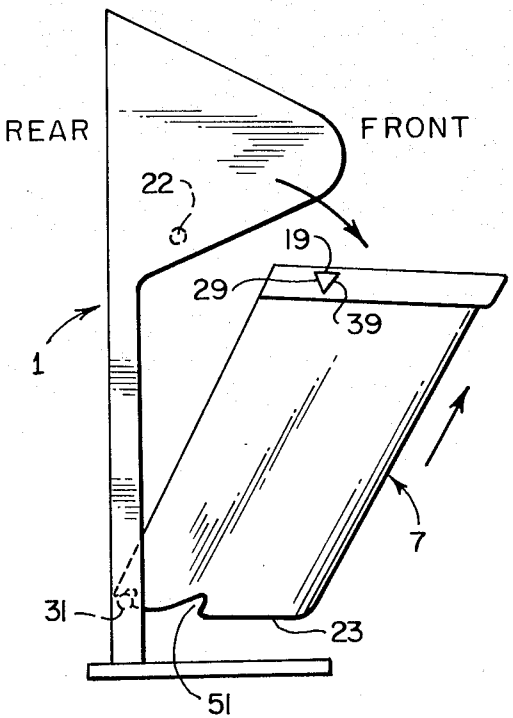
Figure 6:
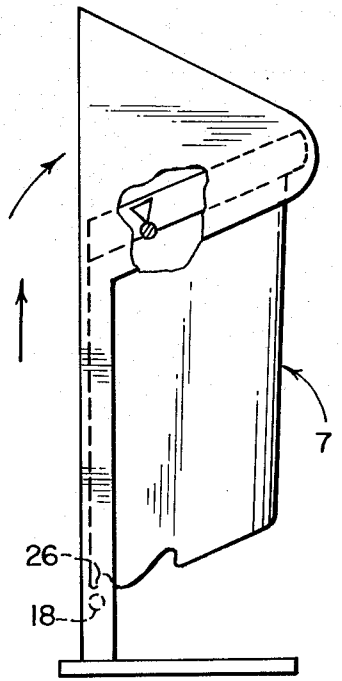
Figure 5:
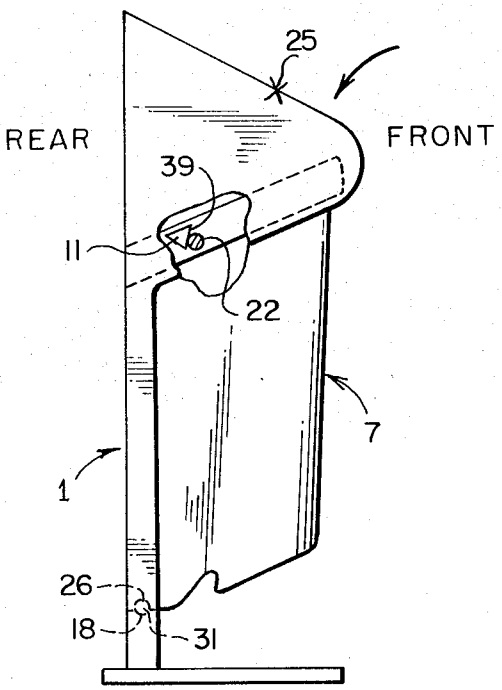
Figure 8:
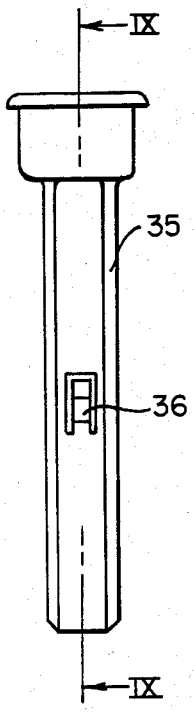
Figure 9:
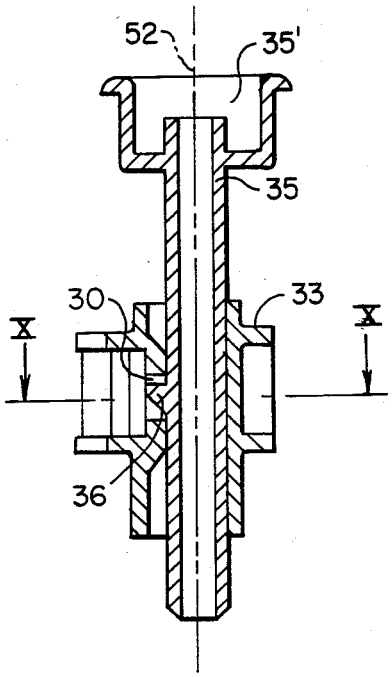
Figure 10:
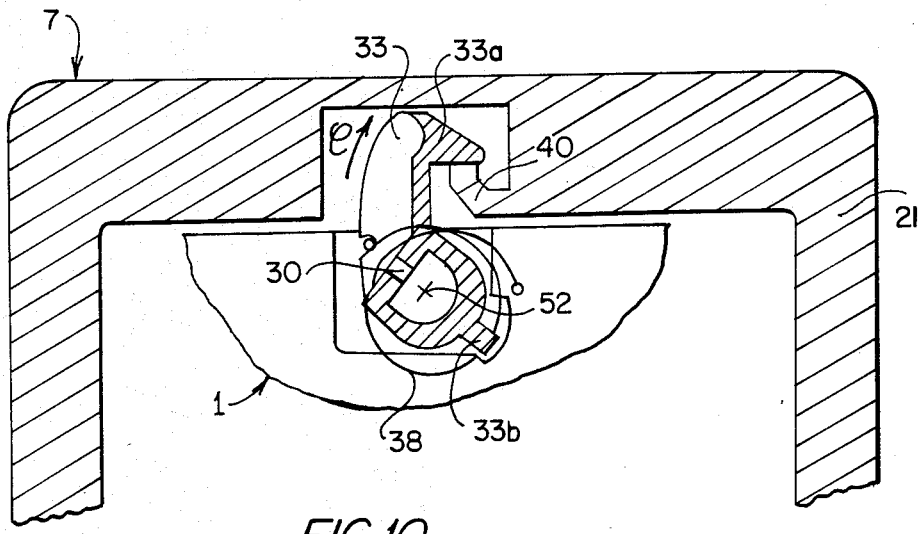
Figure 12:
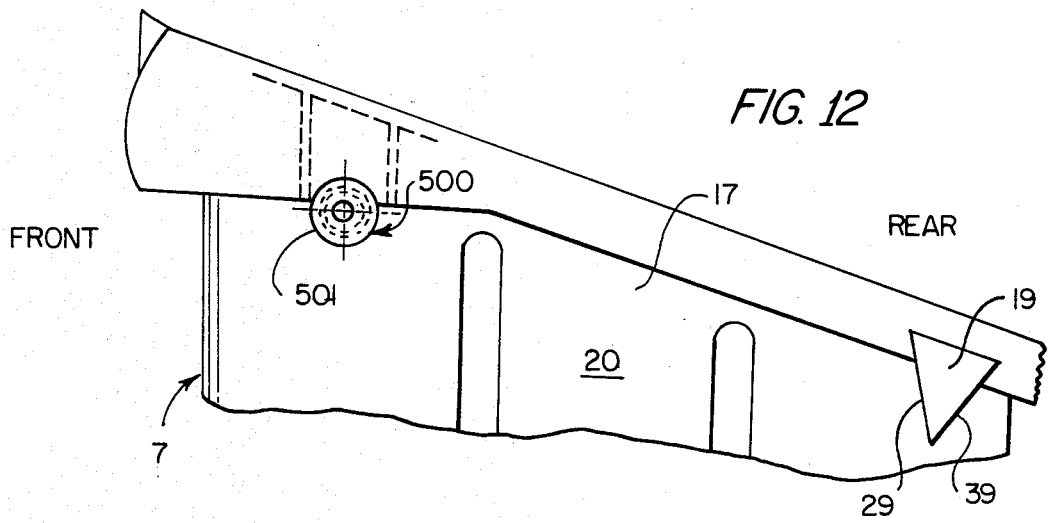
Figure 13:
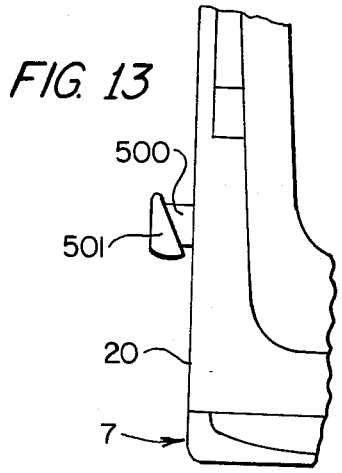
Figure 14:
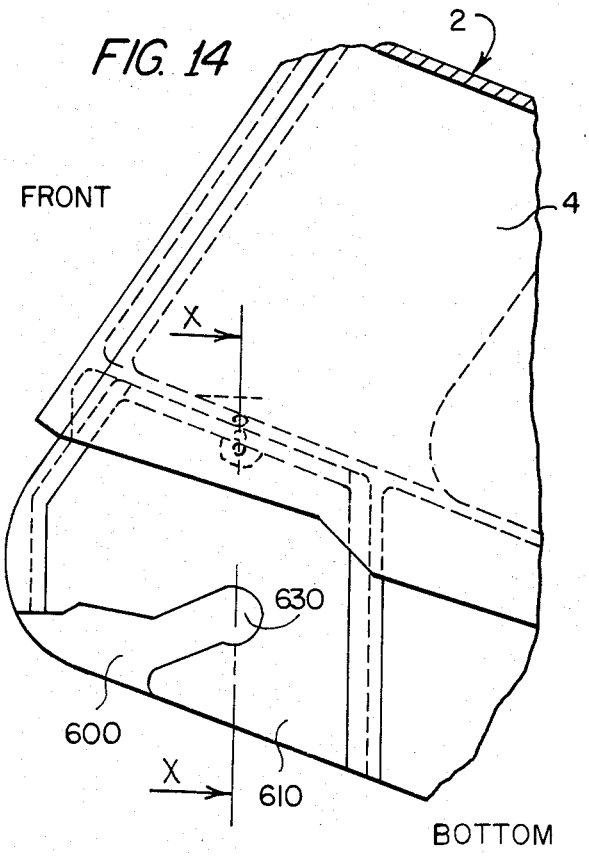
Figure 15:
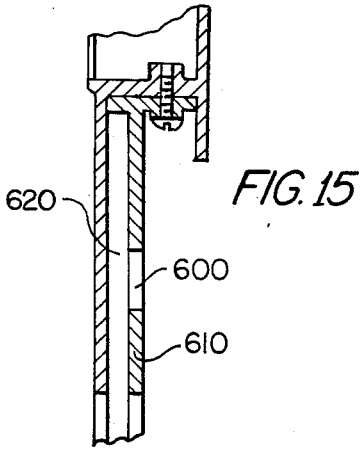

FIG. III shows a side view along 3 of the tub shown in FIG. 2;

FIG. 4 shows in detail the area of the tub designated by IV shown in FIG. 3;

FIG. 5 shows the tub in position on the support column;

FIG. 6 shows the tub slightly lifted up and detached from the holding shaft after unbolting;

FIG. 7 shows the tub after pivoting ready to be detached from the support column;

FIG. 8 shows a frontal view of the bolting control shaft;

FIG. 9 shows a cross-section view along IX—IX of the shaft shown in FIG. 8 equipped with a movable bolting hook;

FIG. 10 shows a partial cross-section view of the movable hook that cooperates with the tooth provided on the tub;

FIG. 11 shows an attachment strap, according to the invention, for a waste-paper basket;

FIG. 12 is a partial outer side view of the tube including a rigidifying stud;

FIG. 13 is also a partial exterior view, from above, of the tub with its stud having a head in the form of a cam;

FIG. 14 is a partial inside view of a lateral panel of the tub-cover reinforced by a holding cheek;

FIG. 15 is a cross-section view along XV—XV of the panel illustrated in FIG. 14;

FIG. 16 is a partial view from above, in cross-section, of the tub's bolting hook and tooth according to a variant realization; and FIG. 17 is a cross-section view from above of a variant realization of a holding strap for the basket.

DETAILED DESCRIPTION OF THE INVENTION

Figure 1:
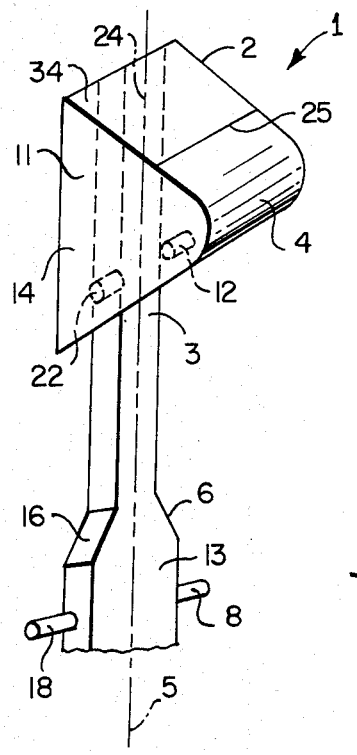
FIG. 1 shows a diagrammatic view in perspective of the main part of the support column.

Referring first to FIG. 1, the support column viewed in its entirety 1 has towards its upper part 11 a part 2 forming a tub-cover integral with an essentially vertical elongated central beam 3 in the basket's position of use, i.e., when the basket is attached to a post or held on the ground. In the example shown in FIG. 1, the tub-cover 2 includes two essentially vertical panels 4, 14, an upper wall 24, which can be inclined in relation to the horizontal, and a rear surface 34 completely solid with the beam 3. The rim 25 of the upper wall 24 is positioned so as to allow passerby to easily toss litter into the receptacle tub provided for this purpose. The beam 3 includes towards its lower part 13 a form that flares out laterally on either side of the median axis 5, presenting two inclined planes 6, 16 to guide the tube 7. On the flared part are arranged two projecting parts 8, 18 which may for example take the form of swivel pins, extending from the lateral surfaces of the flared part towards the outside.

Referring now to FIG. 2, one finds a tub 7 detachable from the support column 1 and intended to receive the litter. The tub 7 includes towards its upper end 17, and in the example shown, two projecting forms 9, 19 arranged laterally on the sides of the tub. The projecting forms 9, 19 extend from the external lateral walls 20 towards the outside, each taking the form of a triangle having two inclines 29, 39, with one of the points of the triangle pointing essentially downward. The two inclines 29, 39 cooperate with two projecting parts 12, 22 placed for this purpose on the lateral panels 4, 14 of the support column 1. The parts 12, 22 extend from the inner part of the lateral panels 4, 14 towards the outside.

It will however be noted that it is sufficient for the projecting forms 9, 19 to have one incline 29 or 39 that cooperates with an incline formed on the projecting parts 12, 22 of the support column 1. These parts 12, 22 may for example take the form of two swivel pins providing at least one rounded incline that cooperates with the incline(s) of the tub 7.

The tub-cover of the invention illustrated in particular in FIG. 1 is open towards the front and downward and includes no means of rigidifying to one another the two lateral panels 4, 14 of the tub-cover, in particular towards their lower front part.

Hence these panels, although made rigid and sturdy, could be twisted or damaged by potential vandals if a major effort to deform them were made.

This is why, in one variant realization (FIGS. 12 to 15), each of the lateral panels 4, 14 of the tub-cover is reinforced by a cheek 610 placed slightly apart towards the inside of the corresponding panel, and in which is provided a groove 600 forming a slide intended to receive a stud 500 projecting laterally towards the outside walls 20 of the tub on the support column in the intermediate space 620 provided between the cheek 610 and the facing lateral panel 4, 14.

The cheeks preferably extend essentially perpendicular to the panels, and the grooves opening downward and towards the front include towards their bottom a seating 630 forming a stop to receive the studs in the tub's bolted position.

As illustrated in FIG. 12, the studs 500 are formed on the upper part end 17, towards the front of the tub (and in front of the projecting forms 9, 19), their head 501 being, advantageously, cam-shaped (FIG. 13), the broadest part of which bears against the walls of the intermediate space 620, whenever the tub is engaged in the bolting position on the column, so as to leave it virtually no transversal play.

In FIGS. 14 and 15, the cheeks have been inserted and attached to the panels by screws. However, they could equally well be realized by casting with the panels.

In reference once again to FIG. 2, the tub 7 has a hollowed-out form 21 extending essentially vertically along its rear face 27. The hollowed-out form 21 is adapted to cooperate with the beam 3 of the support column 1. It thus includes two vertical walls 28 over the greater part of the tub's height which flare out towards the base 37 of the tub, at an angle complementary to that of the flared part of the beam 3.

The tub 7 is articulated around the support column 1 towards its base 37. For this purpose, the tub 7 has a pivoting device that includes two grooves 26 in the shape of an inverted trough, grooved on either side of the form 21 in the bottom 23 of the tub 7. The grooves 26 extend coaxially along the transversal axis 31 of the inclined wall 28 towards the inside of the tub without emerging at the sides (or lateral walls) of said tub. As shown especially in FIG. 4, each groove 26 is provided with at least one rib 32 forming a half-bearing pointing downward. Each rib, extending towards the inside of said grooves 26, cooperates in the position of use with the projecting parts, or swivel pins 8, 18, that extend transversely to the beam 3, having been provided for this purpose on said beam.

Returning to FIG. 3, one notes that the bottom 23 of the tub 7 includes a hollow depression 51. This depression extends essentially parallel to the rear face 27 of the tub.

In order to prevent the person responsible for emptying the tub from being able to set it on the ground after the operation, without repositioning and rebolting it to the support column 1, the bottom 23 of the tub is inclined downward, back to front (i.e., towards the rear face 27 of the tub).

Referring now to FIG. 9, one notes that the means for hooking and bolting the tub 7 onto the support column include a movable hook 33 that pivots around the essentially vertical axis 52 and is solid with a control shaft 35. The hook 33 is provided with a part to return it to closed position, for example a spring 38, and cooperates with a tooth 40 placed on the rear face 27 of the tub 7 (FIG. 10). In the position of use, the control shaft is arranged essentially vertically, inside of the beam 3 and on its upper part, so as to allow the hook 33 to cooperate by its end **33*a* with the tooth 40. In addition, the control shaft 35 is solid with the hook 33**:

in rotation, by its outer form having a section that is at least locally not circular, which cooperates with the corresponding inner section of the hook;

in vertical translation by a clip 36 intended to be inserted into a seating 30 provided for this purpose on said hook.

The rotation of the hook 33 drawn back by the spring is limited by a catch **33*b***.

FIG. 16 shows a variant realization of the means of hooking and bolting the tub 7 not the support column 1.

This form of realization differs from that illustrated in FIG. 9 in that the tooth 40 extends (at 400) beyond the plane passing through the center of rotation (52) of the hook 33 which constitutes the operating plane of the tub in relation to the support column, and in that the hook 33 includes a release 300 recessed in the direction of extension 400 of the tooth 40. Thus, in the case of premature pulling on the tub 7 essentially parallel to the axis of operation 100 without prior unbolting, the hook will tend not to pivot in the direction of its release from the tooth 40 but on the contrary will tend to be caused to self-bolt under the effect of a couple C′ directed towards a tighter engagement between the hook at the point of its withdrawal 300, and the tooth, at the point of its extension 400.

In FIG. 9 it will be noted that the tub's operating plane is represented by the axis 100, the arrows 101 and 102 representing, respectively, the directions of engagement and disengagement of said tub 7 onto the support columns.

Referring now to FIG. 11, one sees a strap for fixing in position a waste-paper basket according to the invention, having two half-shells 42, 43, one inner 43, the other outer 42, provided with at least one means of tightening making it possible to enclose a post 44 set in the ground and accessible solely when the strap 41 is not held in close contact with the support column 1, and at least one means of attaching the strap 41 onto the support column 1 accessible solely when the tub 7 is detached from said support column. In the example given, the strap 41 has two means of tightening, each including a screw 45 placed in a passage 46 formed in the two half-shells 42, 43 and which passes through them both. More particularly, the head 47 of the screw 45 is accessible only through that part of the passage 46 that emerges onto the surface of the inner half-shell 43 in contact, when in position, with the support column. The screw 45 cooperates with a nut 48, free in translation but blocked in rotation against the walls 46' of the passage 46 of the outer half-shell 42. In the example shown in FIG. 11, the two tighteners are arranged symmetrically on either side of the median axis 53.

The inner half-shell 43 is, in addition, held in tight contact with the support column 1 by two means of attachment placed symmetrically on either side of the axis 53, These means of attachment consist of two screws 49, the foot 49' of which emerges into the half-shell 43 and the head 49'' of which emerges into a seating 50 provided for this purpose on part of the support column; the head 49'' of the screws 49 is accessible only when the tub 7 is not held against the support column 1.

In FIG. 17 is shown a variant realization of the strap.

In this figure, the strap, marked 200, is only inserted between the support column 1 and the post, or some similar element 44, so as to ensure as above that the basket is held in place and attached to the post.

Preferably two mountings 206, 207 are provided on the two opposite sides of the strap to receive the column 1 and the post 44, respectively.

In the illustration shown, the strap 200 includes a body 201 in which a passage 202 has been made that emerges at its ends 203, 204 laterally to the strap on the side of the post 44. The passage 202 communicates with an opening 205 that opens onto the side of the strap directed towards the column 1.

A collar, or some similar element 213, ensures that the strap is held in place by enclosing the post 44 and extending into the passage 205. Preferably, the wall 215 of the passage against which the collar 213 bears is curved so as to facilitate the installation of the latter and prevent deformation stress.

Means for attaching the column 1 to the strap 200 are also provided. These may in particular consist of two screws 211, 211' penetrating two cooperating holes 209, 209' formed in the body of the strap. The heads 212, 212' of these screws are preferably not easily accessible except when the tub 7 is detached from the column 1.

Complementary means of attaching the strap onto the post may also be provided, such as a pin 208 held in an essentially central hole formed in part of the body 201 of the strap.

This pin may in particular be welded to the post. As illustrated, its head 208' emerges into the passage 202 at the point of the opening 205 and is accessible only when the column 1 is detached from the strap.

In what follows, the operation of unbolting the tub from the support column will be described.

At the start of the operation, the tub 7 is in position on the support column (FIG. 5); that is, the tub's device for pivoting around the horizontal axis 31 cooperates with the projecting parts 8, 18, and the hook 33 cooperates with the tooth 40 so as to bolt the tub 7 onto the support column 1. Bolting has been achieved by pushing the tub 7 towards the support column 1, the hook 33 blocking the tub by engaging onto the tooth 40 by means of the return spring 38 which, when stretched, automatically returns the hook to its position of engagement with the tooth by means of its return couple C (FIG. 10).

It will be noted as well that when the tub 7 is in position on the support column 1 the projecting elements 9, 19 of the tub 7 are located behind the projecting parts or swivel pins parts 12, 22 of the support column 1. In order to clarify the explanations, in FIG. 5 the front and rear faces of the basket have been marked, the read face being the one where the rear face 27 of the tub 7 cooperates with the beam 3 of the support column.

In order to detach the tub from the support column, the tub is first unbolted. For this purpose, the movable hook is disengaged from the cooperating tooth by causing it to pivot around its vertical axis 52 by acting on the head 35' of the control shaft 35. However, the tub rotates only very slightly around its pivoting axis 31; it is in fact held in position by the cooperating inclines 39 of projecting forms 9 and 19 and projecting parts 12 and 22. In order to separate the tub and the support column, after the unbolting operation, the tub 7 must be lifted up slightly while pulling it forward (the tub can then be guided by the studs 500 with their broad heads 501 sliding in the grooves 600 of the cheeks 610), which makes it possible to disengage to top of the inclines 39 of the tub 7 from the cooperating inclines of projecting parts 12, 22 of the support column 1, as shown by the arrows in FIG. 6. The tub 7 can then be made to pivot, if wished, around the support column 1, along the horizontal axis 31, since the inclines 39, 29 of the projecting forms 9, 19 of the tub are located in front of the cooperating inclines of projecting parts 12, 22 of the support column 1. To facilitate handling, the user may grasp the tub 7 both by its upper part and by the inner depression 51 located on the bottom 23 of the tub, as shown in FIG. 7.

As regards the operation of returning the tub 7 to position on the support column, it will only be noted that before the bolting operation it is only necessary to push the tub back, while lifting it up slightly, towards the support column, causing the inclines 29 of projecting forms 9 and 19 and projecting parts 12, 22 to cooperate and engage the studs 500 in the grooves of the cheeks 610 (when provided).

When the basket is attached to a post by means of one of the straps according to the invention, it is necessary for the tub 7 to be detached from the support column (FIG. 7) in order to have access to the means of attachment of the support column 1 to the strap. In addition, it is only when said strap has been separated from said support column (by unscrewing the assembly screws) that access can be had to the means of tightening the strap onto the post 44. The strap tighteners make it possible to enclose a post having a diameter falling within a range of between 40 and 90 mm, or 90 and 200 mm, for example.

As can be seen from the foregoing, the invention is not limited to the mode of realization and application that has been more specially considered in the description. In particular, it may be provided that the tub 7 have at least on one part of its rear face 27 a single projecting part 9 placed and held parallel to the upper part of said rear face by means provided for this purpose. The projecting part 9 would then have at least one incline (29, 39) cooperating with the projecting parts 12, 22 provided on the rear wall 34 of the support column 1. This mode of realization likewise makes it possible to achieve an important characteristic of the invention according to which the tub is held against the support column, even after unbolting.

Furthermore, other forms of realization of the inclines 29 and 39 of projecting forms 9 and 19 and projecting parts 12 and 22 may be designed in order to make them cooperating: cylinder, diamond, or any other shape adapted to be complementary.

Finally, it is noted that the shapes of the two half-shells 42, 43 of the strap 41 are preferably, as shown in FIG. 11, identical and adapted in order to create between the two half-shells (when these are joined) an empty space 54 in which the post 44 is positioned, and to make it possible, if necessary, to fix a trash can according to the invention onto each of the two half-shells 42, 43 symmetrically on either side of the post 44.

Indeed, the symmetry of the half-shells in particular allows the opposite contact faces 42', 43' respectively of the half-shells 42 and 43 to cooperate each with a support column 1 of a trash can. In this case, each of the trash cans is attached to the strap 41 by screws 49 that are inserted into the holes 55 of each of the two half-shells, after tightening the strap 41 onto the post by the screws 45, the heads 47 of which can be made to emerge either on one face only 42' or 43', or on both faces, since the passages 46 in which the screws 45 are inserted emerge onto both faces 42' and 43'.

We claim:

1. Waste-paper basket comprising:

a detachable tub for receiving litter;

a support column against which the detachable tub is supported in a vertical position by a hook and bolt system, the hook and bolt system locking the tub in a vertical position against the support column;

means for pivoting the tub around an essentially horizontal axis located towards the base of the tub, with respect to the support column;

a tub cover integrally formed at the upper portion of the support column, the tub cover having two lateral panels;

cooperating means holding the tub essentially in its vertical position after the hook and bolt system has been disengaged to unlock the tub for preventing the tub from tilting forward, the cooperating means including:

first projecting means arranged laterally on the sides of the tub and towards the upper end thereof; and second projecting means arranged on the lateral panels of the tub cover, the first and second projecting means coming into abutment for holding the tub in its position of use when the tub is unlocked.

2. Waste-paper basket according to claim 1, wherein the waste-paper basket further comprises essentially parallel cheeks formed slightly separated from the inside from each of the lateral panels of the tub-cover, each of the cheeks having a groove for receiving a stud formed on each of the outer side surfaces of the tub, each of the studs being extended by a broadened head in the form of a cam which lodges in the intermediate space between the corresponding cheek and panel.

3. Waste-paper basket according to claim 1, wherein the tub has a hollowed-out form adapted to cooperate with the support column and extending essentially vertically along the rear surface of the tub.

4. Waste-paper basket according to claim 1, wherein the pivoting means has two grooves made on either side of the hollowed-out form in the bottom of the tub, each pivoting means providing with at least one rib forming a half-bearing, pointing downward, extending towards the inside of said grooves and cooperating in its position of use with the pivots provided for that purpose on the flared part of said beam.

5. Waste-paper basket according to claim 1, wherein the hook-and-bolt system on the support column has a movable hook integral with a control shaft, provided with a return part in closed position, and which cooperates with a tooth provided complementarily towards the rear of the tub.

6. Waste-paper basket according to claim 5, wherein the tooth extends at beyond the operating plane of the tub in relation to the support column, this plane passing through the center of rotation of the hook, and the hook having a release recessed in the direction of the extension of the tooth.

7. Waste-paper basket according to claim 5, wherein the control shaft is arranged essentially parallel to the support column, inside of same, and is provided with a clip intended to be inserted into a seating provided on said hook.

8. Waste-paper basket according to claim 1, wherein the bottom of the tub has an inner depression extending essentially transverse to the tub, so as to facilitate grasping of same.

9. Waste-paper basket according to claim 1, wherein the bottom of the tub is inclined downward, from front to back.

10. Waster-paper basket according to claim 1, wherein the first projecting means comprise two V-shaped inclines and the second projecting means comprise two swivel pins.

* * * * *

UNITED STATES PATENT AND TRADEMARK OFFICE

CERTIFICATE OF CORRECTION

PATENT NO. : 4,776,480

DATED : October 11, 1988

INVENTOR(S) : Alain Triadu, et al.

It is certified that error appears in the above-identified patent and that said Letters Patent is hereby corrected as shown below:

In the Abstract, line 4, delete "(2)".

In the Abstract, line 5, delete "(2)" (first occurrence).

Column 1, line 46, change "includes its" to --includes towards its--.

Column 2, line 3, change "III" to --3-- and change "along 3" to --along arrow III--.

Column 2, line 16, after "along" insert --line--.

Column 2, line 24, change "tube" to --tub--.

Column 2, line 50, change "passerby" to --passersby--.

Column 2, line 54, change "tube" to --tub--.

Column 4, line 32, change "not" to --onto--.

Column 4, line 52, change "columns" to --column--.

Column 5, line 10, change "53," to --53.--.

Column 5, line 65, delete "or".

Column 5, line 66, delete "swivel pins parts".

Column 5, line 68, change "read" to --rear--.

UNITED STATES PATENT AND TRADEMARK OFFICE

CERTIFICATE OF CORRECTION

PATENT NO. : 4,776,480

DATED : October 11, 1988

INVENTOR(S) : Alain Triadu, et al

It is certified that error appears in the above-identified patent and that said Letters Patent is hereby corrected as shown below:

Column 6, line 16, change "to top" to -- the top --.

Signed and Sealed this

Eleventh Day of April, 1989

*Attest:*

*Attesting Officer*

DONALD J. QUIGG

*Commissioner of Patents and Trademarks*